US005712046A

United States Patent [19]

Kamidaira et al.

[11] Patent Number: 5,712,046

[45] Date of Patent: Jan. 27, 1998

[54] TITANIUM RING FOR AN ELECTRODEPOSITION DRUM AND A METHOD FOR ITS MANUFACTURE

[75] Inventors: Toru Kamidaira, Joetsu; Seishi Ishiyama, Amagasaki; Noriyasu Ikeda; Daiharu Doi, both of Joetsu, all of Japan

[73] Assignee: Sumitomo Metal Industries, Ltd., Osaka, Japan

[21] Appl. No.: 675,482

[22] Filed: Jul. 3, 1996

[30] Foreign Application Priority Data

Jul. 4, 1995 [JP] Japan ..... 7-191111
Jul. 4, 1995 [JP] Japan ..... 7-191113

[51] Int. Cl.[6] ..... C21D 9/08

[52] U.S. Cl. ..... 428/586; 204/212; 204/281; 204/272; 205/73; 205/77

[58] Field of Search ..... 148/421; 428/586; 204/212, 272, 290 R, 280, 281; 205/73, 77; 191/1 A; 492/28; 138/143

[56] References Cited

U.S. PATENT DOCUMENTS 3,767,537 10/1973 Selker ..... 204/281
4,647,345 3/1987 Polan ..... 204/216

FOREIGN PATENT DOCUMENTS 60-9866 1/1985 Japan .
3-28505 4/1991 Japan .
3-169445 7/1991 Japan .
4-36488 2/1992 Japan .
4-262872 9/1992 Japan .
6-93400 4/1994 Japan .
6-93401 4/1994 Japan .
6-335769 12/1994 Japan .

*Primary Examiner*—John Sheehan
*Attorney, Agent, or Firm*—Burns, Doane, Swecker & Mathis, LLP

[57] ABSTRACT

A titanium ring for an electrodeposition drum has an attractive, uniform surface without patterns comprising bright and dark spots which are formed during surface polishing. The ring has a thickness of 4–30 mm and a surface hardness when it has been polished to an average surface roughness Ra of at most 0.3 μm such that the difference between the maximum and minimum Vickers hardness measured with a load of at most 1 kg at 10 or more points disposed at a pitch of 0.3–1 mm along a line in an arbitrary direction along the surface is at most 10. The ring can be manufactured by welding of a rolled plate or by ring rolling of a tube. When the temperature of the material forming the ring is heated to at least its β transformation point, cooling past the β transformation point is carried out at a rate of at least 1000° C. per hour. Subsequent working or heat treatment is carried out below the β transformation point.

7 Claims, No Drawings

TITANIUM RING FOR AN ELECTRODEPOSITION DRUM AND A METHOD FOR ITS MANUFACTURE

BACKGROUND OF THE INVENTION

1. Field of the Invention

This invention relates to a titanium ring which forms the outer surface of an electrodeposition drum used in the manufacture of electrodeposited metal foil. It also relates to a method of manufacturing such a titanium ring.

2. Description of the Related Art

In recent years, the use of electrodeposited metal foil, and particularly electrodeposited copper foils, which are employed as wiring in electronic equipment, has greatly increased. Electrodeposited copper foil is used for the manufacture of wiring, such as that on printed wiring boards.

Industrial production of electrodeposited metal foil (such as copper foil) is carried out by the electrodeposition of a metal (such as copper) on a roll-shaped electrode, commonly referred to as an electrodeposition drum, having a diameter on the order of 2 meters. During use, an electrodeposition drum is exposed to highly corrosive electroplating liquids, so it must have good corrosion resistance. Therefore, in recent years, electrodeposition drums have been developed which take advantage of the excellent corrosion resistance of titanium and have a titanium ring fitted on the outer surface of the drum.

A titanium ring for an electrodeposition drum is generally formed by one of the following two methods:

(a) a welding method in which a plate obtained by hot working of a titanium ingot is formed into a tubular shape of a prescribed outer diameter and the opposing ends of the plate are welded to each other; or (b) a ring rolling method in which a tube formed by hot working of a titanium ingot is formed into a ring of a prescribed outer diameter by rolling in a ring rolling mill.

Whichever method is used, the resulting titanium ring is shrink fit around an inner drum made of carbon steel or other material to obtain an electrodeposition drum, and then the outer surface of the titanium ring is subjected to grinding and polishing. After polishing, the surface of the titanium drum is printed with an electrodeposited copper foil which is to be formed into wiring, so it is necessary for the surface of the titanium ring to be extremely smooth and regular.

When the welding method (a) is used, the titanium ingot which is formed by a melting process is hot forged and then hot rolled at a temperature in the range of 700°–1000° C. to obtain a titanium plate. The plate is formed into a cylinder of a prescribed outer diameter, and the abutting ends are then welded to each other by a method such as TIG welding or plasma welding to obtain a titanium ring. However, this method has the problems that even if the titanium ring is carefully polished prior to use, a pattern corresponding to coarse grains and transformed structures which are formed at the seam of the ring appears on the surface of the ring at prescribed intervals, and the pattern is printed with an electrodeposited copper foil. This portion of the foils must be discarded, resulting in a decreased yield.

This problem can be resolved by performing plastic working of the seam and then performing annealing to recrystallize the coarse grains and the transformed structure and to give the welded seam the same structure as the base metal (see Japanese Published Unexamined Patent Applications Nos. Hei 4-36488, 4-262872, and 6-335769).

The ring rolling method (b) was developed in order to solve the above-described problems associated with the welding method by doing away with the need for a welded seam. This method is described in Japanese Published Unexamined Patent Applications Nos. Hei 3-169445, 6-93400, and 6-93401.

However, as a result of the problem of a pattern corresponding to the coarse grains and the transformed structure of a welded portion appearing in a printed copper foil having been solved by the ring rolling method, attention has shifted towards another surface imperfection of titanium rings, which was not previously considered to be a problem. This is the occurrence of scarcely visible, fine patterns of light and dark spots cause by variations in the gloss of the titanium ring after polishing. The pattern on the polished surface due to variation in the gloss end up being printed on the electrodeposited copper foil, and the presence or absence of this pattern determines the value of the copper foil product.

Japanese Published Unexamined Patent Application No. Sho 60-9866 pointed out the appearance of a relatively striking irregular polished pattern due to the nonuniform structure of titanium. For this reason, adjustment of the titanium structure by recrystallization annealing or other methods has been carried out to obtain a uniform and fine macrostructure and microstructure. However, even adjustment of the structure cannot completely solve the problem of fine patterns of brightness and darkness on the surface of a titanium ring after polishing.

SUMMARY OF THE INVENTION

It is an object of the present invention to provide a titanium ring for use with an electrodeposition drum which does not have fine patterns of bright and dark spots on its surface after polishing (referred to below as polished surface patters).

It is another object of the present invention to provide a method of manufacturing such a titanium ring.

According to one aspect of the present invention, a titanium ring for the outer surface of an electrodeposition drum for electrodeposition of a metal foil has a thickness of 4–30 mm. When the surface has been polished to an average roughness Ra of at most 0.3 μm, the difference between the maximum and minimum Vickers hardness measured at 10 or more locations with a pitch of 0.3–1 mm along a line in an arbitrary direction with a load of at most 1 kg is less than 10, and the surface is without polished surface patterns.

A method according to the present invention of manufacturing a titanium ring for an electrodeposition drum by hot working of a titanium ingot is characterized in that the last time cooling is performed from at least the β transformation point, and the cooling rate is at least 1000° C. per hour when the β transformation point is crossed.

For example, in the welding method in which a titanium ingot is hot worked to form a plate, the plate is bent into a cylindrical shape, and the opposing ends of the plate are welded to each other to form a ring, if during the cooling of the ingot, or during hot working, or during a cooling stage of heat treatment of the ingot or a material formed by working of the ingot, cooling takes place at a rate of at least 1000° C. per hour when the β transformation point is crossed, subsequent working or heat treatment can take place at a temperature below the β transformation point.

In the ring rolling method in which a titanium ingot is hot worked to form a tube and the tube is subjected to ring rolling to obtain a ring, if during the cooling of the ingot, or during hot working, or during ring rolling, or during a cooling stage of heat treatment of the ingot or the worked material, cooling takes place past the β transformation point at a rate of at least 1000° C. per hour, subsequent working or heat treatment can take place at a temperature below the β transformation point.

The present invention was made based on the following knowledge.

(a) Polished surface patterns composed of local variations in the gloss after polishing of a titanium ring are caused by the fact that the surface of a titanium ring does not have a uniform hardness. Rather, there is a distribution of hardness, with portions of higher hardness mixed with portions of lower hardness. Due to the distribution of hardness of the surface of a titanium ring, there is a slight difference in the ability of different portions to be polished, and this results in the formation of fine patterns composed of bright and dark spots on the surface after polishing.

(b) When there is a distribution of hardness, the crystal orientation differs between regions of higher and lower hardness. In regions of higher hardness, aggregates of crystal grains are formed in which the C-axis direction of hexagonal crystals is nearly perpendicular to the surface of the titanium ring.

(c) Such aggregates of crystal grains form during cooling from the β temperature range to the β temperature range of the ingot or a material undergoing subsequent hot working. When the β transformation point is passed for the last time, formation of the aggregates can be prevented by rapid cooling at a speed of at least 1000° C. per hour. Namely, in the manufacture of a titanium ring, if the above-described rapid cooling is performed during the cooling of a titanium ingot or during a cooling stage of subsequent hot working or heat treatment, and all subsequent working or heat treatment is carried out at a temperature less than the β transformation point, the formation of aggregates of crystal grains which make up hard portions of the surface can be suppressed, and a titanium ring for an electrodeposition drum without polished surface patterns can be manufactured stably and with certainty.

(d) A titanium ring manufactured in this manner has a hardness distribution such that the difference between the Vickers hardness at the locations of maximum and minimum hardness is a low value of at most 10. Namely, if the hardness distribution is decreased so that the difference is at most 10, polishing does not cause the formation of patterns on the surface of the titanium ring.

DESCRIPTION OF PREFERRED EMBODIMENTS

In this invention, "titanium" includes pure industrial titanium such as that specified by JIS H4600, as well as α-type titanium alloys containing one or more alloying elements selected from Pd, Ru, Pt, Ta, Ni, Co, Mo, W, etc., with each alloying element being present in an amount of at most a few weight %.

The thickness of the titanium ring is 4–30 mm and preferably 6–20 mm. If the thickness is less than 4 mm, a sufficient current density during electrodeposition cannot be attained due to heat generation, etc., so electrodeposition cannot be performed efficiently. If the thickness is greater than 30 mm, an adequate working ratio cannot be achieve, so even if the above-described rapid cooling is performed, the structure of the titanium becomes nonuniform, and it becomes difficult to prevent polished surface patterns.

In the present invention, when the surface has been polished to an average roughness Ra of at most 0.3 μm, the surface hardness distribution is evaluated based on the difference between the maximum and minimum Vickers hardness measured with a load of at most 1 kg at 10 or more points arranged at a pitch of 0.3–1 mm along a line in an arbitrary direction. If the difference is at most 10, formation of the above-described polished surface patterns can be prevented. The reason for the limitations on the measurement conditions of the surface hardness distribution are as follows.

If the average surface roughness Ra of a titanium ring is greater than 0.3 μm, the error in measuring the hardness becomes large due to the roughness. If the pitch between measurement points is less than 0.3 mm, the indentations formed during Vickers hardness measurement overlap or become too close to each other and work hardening is produced. On the other hand, if the pitch between measurement points is greater than 1 mm, or if the number of measurement points (measurement locations) is less than 10, the chances increase of the measurement points' missing the locations of aggregates of hard crystal grains. Furthermore, if the measurement load is greater than 1 kg, the indentations produced by measurement become too big, creating the danger of simultaneous measurement of hardness at the location of an aggregate of hard crystal grains and at another location. In either of the above cases, it is not possible to accurately measure the hardness.

A titanium ring having a highly uniform hardness distribution such that the difference between the maximum hardness and minimum hardness as measured by the above-described method is at most 10 can be manufactured in the following manner. A titanium ring is formed by hot working of a titanium ingot. During a cooling stage of the ingot, during hot working, or during a cooling stage of heat treatment of the ingot or the worked material, the titanium is rapidly cooled at a cooling rate of at least 1000° C. per hour and preferably at least 1500° C. per hour past the β transformation point of the titanium. The β transformation point depends on the type and content of the added elements but is normally 850°–950° C.). Treatment subsequent to the rapid cooling (working or heat treatment) is carried out in a temperature range below the β transformation point. Namely, it is sufficient if the last time that the titanium is cooled from a temperature equal to or higher than its β transformation point, the cooling rate is at least 1000° C. per hour when the β transformation point is crossed. During the cooling process, after the β transformation point has been crossed, it is not necessary for the cooling rate to be at least 1000° C. per hour, and a lower cooling rate may be employed.

It has not been fully elucidated why a manufacturing method satisfying the above-described conditions is capable of providing a titanium ring which has a uniform hardness distribution on its surface and which, as a result, does not have polished surface patterns after polishing. At the present time, it is thought that if the cooling rate is set to be at least 1000° C. per hour when the β transformation point is crossed, titanium undergoes a martensite transformation, so that the crystal orientation is randomized, and the formation of aggregates of crystal grains in which the C-axis direction of hexagonal crystals is normal to the surface of the titanium ring is suppressed.

The titanium ring can be produced by either the welding method or the ring rolling method described above. Whichever method is used, a titanium ingot is first formed by a melting method such as arc melting using consumable or nonconsumable electrodes, electron beam melting, plasma melting, or other suitable method. When subsequent hot working and heat treatment of the resulting ingot are performed entirely below the β transformation point, the molten titanium which is to form the titanium ingot is rapidly cooled during solidification at a rate of at least 1000° C. per hour when the β transformation point is crossed.

When the welding method is employed, the titanium is subjected to rough forging in a large press or other device. After the resulting slab is hot rolled to form a plate, the plate is formed into a cylinder of a prescribed outer diameter, and the opposing ends of the plate are welded to each other by TIG welding, plasma welding, or other suitable method to obtain a titanium ring.

When the ring rolling method is employed, an ingot (or a block cut from an ingot is subjected to hot working in the form of rough forging and then is pierced to obtain a tube, which is rolled in a ring rolling mill to form a seamless titanium ring of a desired outer diameter.

If necessary, the titanium ring is then subjected to annealing or other heat treatment, and chemical treatment such as acid pickling. The ring is then shrink fit on an inner drum of carbon steel or other material. The surface of the ring is then ground and polished to obtain an electrodeposition drum which can be used for electrodeposition of metal foil. Grinding is carried out to make the ring perfectly round as well as to increase the smoothness of the ring prior to polishing.

According to the method of the present invention, when a titanium ring is formed by either of the above methods, at least the last time the titanium is cooled from a temperature equal to or greater than the β transformation point, the cooling is performed by rapid cooling at a rate of at least 1000° C. per hour when the β transformation point is crossed. This rapid cooling can be performed at the following times during the manufacture of the ring.

(a) When the titanium ingot formed by a melting method is being cooled subsequent to casting;

(b) When the titanium ingot has been heated to above the β transformation point during rough forging (the β transformation point can be crossed either during working or while working is not being performed);

(c) When the titanium has been heated to at least the β transformation point for plate rolling or ring rolling (the β transformation point can be crossed either during working or while working is not being performed);

(d) When a rough forged material (a billet or a tube) or a subsequently worked material is subjected to heat treatment at the β transformation point or above. In order to suppress scale formation and to reduce energy costs, the heat treatment temperature is preferably at most 1200° C.

Rapid cooling past the β transformation point at a rate of at least 1000° C. per hour may be performed during 2 or more of the above stages. The rapid cooling past the β transformation point at a rate of at least 1000° C. per hour is generally performed by water cooling, but it may instead be performed by forced air cooling, roll quenching, or other suitable cooling method.

An example of a process which is suitable from an industrial standpoint is as follows. After a rough forged material is heated to a temperature of at least the β transformation point and at most 1200° C., it is water cooled past the β transformation point at a rate of at least 1000° C. per hour. It is then subjected to plate rolling or ring rolling and, if necessary, annealing or other heat treatment, the rolling and heat treatment all being performed at a temperature below the β transformation point.

In the case of the welding method, after a workpiece has been imparted a thermal history of crossing the β transformation point at a cooling rate of at least 1000° C. per hour, the opposing ends of the plate are welded together. During welding, the metal is only locally heated, so the cooling rate is fast, and aggregates of crystal grains which could produce a surface hardness distribution resulting in polished surface patterns are not formed.

As described in Japanese Published Unexamined Patent Applications No. Hei 4-36488, 4-262872, and 6-335769, in the formation of a titanium ring by welding, after plastic working such as rolling is applied to the welded seam of the ring and an overlay has been flattened, it is desirable to perform annealing or other heat treatment to recrystallize coarse grains and transformed structure in the weld and give the weld the same structure as the base metal. At this time, the plastic working and heat treatment are carried out below the β transformation point.

Shrink fitting of the titanium ring on the inner drum is also carried out below the β transformation point. The shrink fitting is typically carried out at a temperature of 200°–400° C.

According to the method of the present invention, a titanium ring having a surface with little variation in hardness such that the difference between the maximum and minimum Vickers hardness of the surface is at most 10 can be stably produced in large quantities. When the ring is polished after being fit on an inner drum, the surface of the ring can be uniformly polished without the formation of polished surface patterns. Accordingly, an electrodeposition drum having this titanium ring forming its outer surface can be used to manufacture with a high yield electrodeposited metal foil of extremely high quality without patterns composed of bright and dark spots.

The present invention will be explained in greater detail by the following examples, which are presented merely for illustrative purposes and are not intended to limit the scope of the present invention. In the examples, all percents are percents by weight unless otherwise noted.

EXAMPLES

Example 1

Plates of pure titanium (thickness=4.5–18 mm, β transformation point=890°–900° C.) corresponding to JIS H4600 Type 1 and containing at most 0.01% C, at most 0.001% H, at most 0.01% N, 0.03–0.07% O, 0.02–0.05% Fe, and a balance essentially of Ti were formed by the following process.

Titanium ingot (formed by arc melting with consumable electrodes)

(1) rough forging (heat to 1000° C., cool at rate of less than 1000° C. per hour) 150 mm thick slab (2) heat to 950° C., water cool (average cooling rate= 1100° C. per hour)

(3) plate rolling (heat to 800° C.)

Titanium plate (4) heat treatment (holding at 670° C. for 15 minutes)

Namely, following the method of the present invention, after the slab was heated to a temperature of at least the β transformation point, it was cooled at a cooling rate of at least 1000° C. per hour when the β transformation point was crossed. Plate rolling and heat treatment (annealing) were then performed, both at below the β transformation point, to obtain a titanium ring according to the present invention.

For comparison, the above process was repeated except that step (2) of heating to 950° C. and water cooling was omitted to prepare comparative examples of titanium plates. In the comparative process, the last time the titanium was heated to at least the β transformation point was during rough forging, but the cooling rate past the β transformation point was less than 1000° C. per hour.

From each titanium plate, a test piece measuring 30 mm×30 mm was cut, and the surface of each test piece was subjected to wet polishing to obtain an average roughness Ra of approximately 0.2 μm. The hardness of each test piece was then measured using a Vickers hardness meter, set to a load of 1 kg, at 20 test points having a pitch of 0.5 mm, and the difference between the minimum and maximum hardness values was determined.

A region measuring approximately 150 mm×300 mm on the surface of each titanium plate was polished with a PVA whetstone to a finish of #600, and it was determined whether the polished surface had any polished surface patterns visible to the naked eye. The results are shown in Table 1.

As is clear from Table 1, when the cooling rate the last time the titanium was heated to the β transformation point or above was at least 1000° C. per hour when the temperature crossed the β transformation point, the difference between the maximum hardness and the minimum hardness of the surface of the titanium plate was at most 10, and no polished surface patterns could be discerned with the naked eye. In contract, in the comparative examples, when the cooling rate the last time heating was performed to at least the β transformation point was less than 1000° C. per hour when the β transformation point was crossed, the difference between the maximum hardness and the minimum hardness of the surface of the titanium plate was greater than 10, and polished surface patterns were formed. Accordingly, if a titanium ring formed from one of the comparative plates is fit on an inner drum and the resulting electrodeposition drum is used for electrodeposition of metal foil, the polished pattern is printed on the metal foil, and the value of the metal foil formed with this titanium drum is reduced.

Example 2

The procedure of Example 1 was repeated except that the titanium plates of that example were replaced by titanium alloy plates corresponding to JIS H4605 Type 11 (containing at most 0.01% C, at most 0.002% H, at most 0.01% N, 0.04–0.06% O, 0.04–0.07% Fe, 0.16–0.18% Pd, and a balance essentially of Ti) having a thickness of 8–16 mm and a β transformation point of 890°–900° C., and by titanium alloy plates corresponding to ASTM Gr. 12 (containing at most 0.01% C, at most 0.001% H, at most 0.01% N, 0.10–0.12% O, 0.07–0.09% Fe, 0.26–0.30% Mo, 0.70–0.80% Ni, and a balance essentially of Ti) having a thickness of 5–16 mm and a β transformation point of 880°–890° C. Using these materials, titanium plates according to the present invention and comparative examples were formed and tested.

Hardness measurements were performed using a Vickers hardness meter with a load of 500 g at 15 measurement points separated by a pitch of 1 mm. The results are shown in Table 2. It can be seen that similar results can be obtained using a titanium alloy plate as when using a pure titanium plate as in Example 1.

Example 3

Rolled titanium rings formed from pure titanium plates (7.5–28 mm thick) having the same composition as in Example 1 and corresponding to JIS H4600 Type 1 were formed by the following process.

Titanium ingot (formed by arc melting with consumable electrodes)

(1) rough forging (heat to 1050° C., cool at a rate less than 1000° C. per hour)

Tube (outer diameter=580 mm wall thickness=95 mm)

(2) heat to 950° C., water cool (average cooling rate=1500° C. per hour)

(3) perform ring rolling (heating to 700° C.)

Titanium ring (4) heat treatment (hold at 670° C. for 15 minutes)

For comparison, comparative examples of titanium rings were prepared by the above procedure except that step (2) of heating to 950° C. and water cooling was omitted. In the comparative examples, the final heating to at least the β transformation point was during rough forging. As shown above, the cooling rate at this time was less than 1000° C. per hour.

A test piece measuring 30 mm×30 mm was cut from each of the resulting titanium rings, and the distribution of the surface hardness was measured in the same manner as in Example 1. A region of the surface of each titanium ring measuring 150 mm×300 mm was polished in the same manner as in Example 1 and was checked for the presence of polished surface patterns. The results are shown in Table 3. From Table 3, it can be seen that in the case of ring rolling as with plate rolling, if the cooling rate the last time heating is performed to at least the β transformation point is at least 1000° C. per hour when the β transformation point is crossed, the difference between the maximum and minimum Vickers hardness of the surface of the titanium plate is at most 10, and polished surface patterns cannot be observed with the naked eye at all.

Example 4

This example illustrates the effect of the heat treatment conditions of an ingot on the formation of polished surface patterns on a final product.

Pure titanium corresponding to JIS H4600 Type 1 (0.01% C, 0.0005% H, 0.01% N, 0.08% O, 0.07% Fe, and a balance essentially of Ti; β transformation point=890° C.) was melted and cast (cooling rate from solidification: less than 1000° C. per hour) to obtain ingots with a diameter of 730 mm and a length of 2400 mm. Blocks measuring 300 mm thick×500 mm wide×710 mm long were out from the ingots.

The blocks were subjected to heat treatment at the temperatures and cooling rates shown in Table 1, and then were formed into slabs measuring 110 mm thick×1350 mm wide×710 mm long by rough forging at the temperatures shown in Table 1. The slabs were then heated to 800° C. and rolled to form titanium plates measuring 9 mm thick×1350 mm wide×8600 mm long. The plates were annealed by holding at 670° C. for 35 minutes.

Cooling during heat treatment and rough forging was conducted by air cooling, forced air cooling, water cooling (immersion of the material), or roll quenching. The cooling rate was measured with a sheathed thermocouple embedded in a hole pierced in the ingot or the slab. The target cooling rate for each type of cooling was 200°–800° C. per hour for air cooling, 1000°–3000° C. per hour for forced air cooling, at least 3000° C. per hour for water cooling, and at least 10,000° C. per hour for roll quenching. The cooling rate was adjusted by varying the cooling method and the cooling conditions.

Next, the resulting titanium plates were formed into a cylindrical shape with a roll bender at ambient temperature. The opposing ends of each cylinder were beveled to define a V-shaped groove having a groove angle of 50°–140° where the ends met. The opposing ends were welded to each other along the V-shaped groove to obtain a titanium ring. After overlaying of the seam was performed, the overlay was flattened under either warm or cold conditions to make the seam the same thickness as the base metal. The portion subjected to flattening was annealed to refine and increase the uniformity of the grains of the coarse grain structure and transformed structure of the weld. The surface of the titanium ring was subjected to grinding and then polished with an elastic PVA whetstone to a finish of #600. Portions other than the weld were then visually observed for the presence of polished surface patterns. The results are shown in Table 4.

As can be seen from Table 4, when heat treatment of the ingot was performed at a temperature of 950° C. or above, which was higher than the β transformation point, and the cooling rate during subsequent cooling was less than 1000° C. per hour, polished surface patterns were formed in the titanium ring at the time of polishing, but when cooling was performed according to the method of the present invention at a rate of at least 1000° C. per hour when the β transformation point was crossed, the patterns were not formed.

On the other hand, when the heat treatment temperature of the ingot was at most 850° C., which was lower than the β transformation point, varying the cooling rate did not have any particular effect on preventing the formation of polished surface patterns. The effect of the cooling rate at the time of casting (the cooling rate from solidification was less than 1000° C. per hour) continued, and polished surface patterns were formed.

From the above results, it can be seen that the formation of polished surface patterns can be prevented only when the heating temperature is at least the β transformation point and rapid cooling at a rate of at least 1000° C. per hour is performed when the β transformation point is crossed. Furthermore, as can be seen from Run No. 6, if the heating temperature in the subsequent stage of rough forging is made at least the β transformation point but the cooling rate at this stage is less than 1000° C. per hour, polished surface patterns are formed at the time of polishing. Accordingly, after rapid cooling from the β region has been carried out, it is necessary to perform any subsequent working or heat treatment in the α region. In other words, it is sufficient to perform the final cooling from the β region at a rate of at least 1000° C. per hour.

Example 5

This example demonstrates the effects on the formation of polished surface patterns of the conditions during rough forging of an ingot.

The titanium material and procedures employed in this example were the same as in Example 4. However, heat treatment of the blocks cut from the ingots was carried out under the same conditions as for Run No. 4 or Run No. 10 of Table 4 (heat to 1000° C. then cool at 800° C. per hour or heat to 950° C. and cool at 3000° C. per hour). The heating temperature during rough forging and the temperature at the completion of working (the finishing temperature), and the average cooling rate during working and at the completion of working were varied as shown in Table 5. Rolling of the slabs obtained by rough forging into plates and subsequent annealing were carried out in the same manner as in Example 4, but the thickness of the resulting titanium plates was 4 mm. The titanium plates were formed into titanium rings in the same manner as in Example 4, and the rings were subjected to grinding and polishing. The condition of the surface of the rings after polishing is indicated in Table 5.

From Table 5, it can be seen that if the ingot is heated to above the β transformation point during rough forging and the cooling rate during subsequent working or at the completion of working is at least 1000° C. per hour when the β transformation point is crossed, regardless of the prior thermal history of the ingot, polished surface patterns were not observed on the final titanium ring. However, even in the case in which the heating temperature during rough forging is higher than the β transformation point, if the cooling rate during subsequent cooling is less than 1000° C. per hour when the β transformation point is crossed, polished surface patterns cannot be prevented.

On the other hand, if the ingot does not have a thermal history such that the cooling rate during casting was at least 1000° C. per hour when the β transformation point was crossed, even though rough forging is performed at a temperature below the β transformation point, the formation of polished surface patterns cannot be prevented. In contrast, for an ingot having a thermal history such that the cooling rate during casting was at least 1000° C. per hour when the β transformation point was crossed, even though rough forging is performed at a temperature below the β transformation point, the formation of polished surface patterns can be prevented.

Namely, in order to prevent the formation of polished surface patterns, it is sufficient if the cooling rate the last time heating is performed to at least the β transformation point is at least 1000° C. per hour when the β transformation point is crossed.

Example 6

This example shows the effect on the formation of polished surface patterns of the heat treatment conditions of a slab obtained by rough forging.

The following three types of titanium materials were employed in this example. None of the materials had a thermal history such that during rough forging following solidification of an ingot, the cooling rate was at least 1000° C. per hour when the β transformation point was crossed.

Material 1: The same material as used in Example 1 (corresponding to JIS H4600 Type 1, β transformation point of 890° C.)

Material 2: A material corresponding to ASTM Gr. 11 with a β transformation point of 890° C. (containing 0.01% C, 0.053% H, 0.001% N, 0.07% O, 0.05% Fe, 0.17% Pd, and a balance essentially of Ti)

Material 3: A material corresponding to ASTM Gr. 12 with a β transformation point of 885° C. (containing 0.01% C, at most 0.001% H, at most 0.01% N, 0.11% O, 0.08% Fe, 0.28% Mo, 0.72% Ni, and a balance essentially of Ti)

Each slab was subjected to heat treatment under the conditions shown in Table 6, was then rolled to a thickness of 4 mm at a temperature of 800° C., and was then annealed by holding at 670° C. for 15 minutes. The resulting titanium plates were formed into titanium rings using the same method as in Example 4, and the rings were subjected to grinding and polishing. The surface condition of the rings after polishing is shown in Table 6.

As can be seen from Table 6, even though the titanium material does not have a thermal history prior to being formed into a slab of being cooled at a cooling rate of at least 1000° C. per hour when the β transformation point is crossed, if such a thermal history is imparted to the slab during heat treatment, the formation of polished surface patterns on the polished titanium ring formed from the slab can be prevented.

Example 7

This example shows the effect on the formation of polished surface patterns of heat treatment conditions applied to an ingot which is to be formed into a seamless titanium ring by the ring rolling method.

Titanium corresponding to JIS H4600 Type 1 (containing 0.01% C, 0.0005% H, 0.01% N, 0.08% O, 0.07% Fe, and a balance essentially of Ti; β transformation point=890° C.) was melted and cast (cooling rate from solidification: less than 1000° C. per hour) to obtain ingots with a diameter of 840 mm and a length of 2400 mm. Blocks measuring 300 mm thick×810 mm in diameter were cut from the ingots.

The blocks were subjected to heat treatment at the various temperatures and cooling rates shown in Table 7, and then were formed into tubes measuring 60 mm thick and 550 mm in diameter by rough forging (including piercing) at the temperatures shown in Table 7. The tubes were heated to 800° C. and subjected to ring rolling in a ring rolling mill to obtain seamless titanium rings measuring 11 mm thick× 1350 mm wide×2700 mm in outer diameter. The rings were then maintained at 670° C. for 35 minutes for annealing.

The resulting titanium rings were subjected to surface grinding and polishing in the same manner as in Example 4 and were then examined for the presence of polished surface patterns. The results are shown in Table 7.

From Table 7, it can be seen that in the manufacture of a seamless titanium ring by ring rolling of a tube, as in the manufacture of a titanium ring by the welding method, according to the present invention, if an ingot undergoes heat treatment at a temperature higher than its β transformation point and is cooled at a rate of at least 1000° C. per hour when passing the β transformation point, and if the subsequent working and heat treatment are at a temperature lower than the β transformation point, a titanium ring without polished surface patterns can be manufactured.

Example 8

This example shows the effect on the formation of polished surface patterns of the conditions during rough forging of an ingot to be formed into a tube.

In the same manner as in Example 7, a block cut from a titanium ingot was subjected to heat treatment and rough forging, and the resulting tube was subjected to ring rolling and annealing to obtain a titanium ring with a thickness of 11 mm. However, in this example, the heat treatment of the blocks was carried out in the manner of Run Nos. 4 and 10 of Table 7, and the conditions of rough forging were varied as shown in Table 8. The surface conditions of the titanium ring after polishing are shown in Table 8.

From Table 8, it can be seen that in the manufacture of a titanium ring by the ring rolling method, in the same manner as in Example 5, if the ingot is heated to above the β transformation point during rough forging, and if cooling either during or after the completion of the rough forging is at a rate of at least 1000° C. per hour when the β transformation point is crossed, regardless of the prior thermal history of the ingot, a titanium ring without polished surface patterns can be obtained.

Example 9

This example shows the effect on the formation of polished surface patterns of the heat treatment conditions when a tube obtained by rough forging is subjected to heat treatment in the manufacture of a titanium ring by the ring rolling method.

Tubes were formed by rough forging using the three types of titanium materials described in Example 6. During the rough forging, none of the materials was cooled past its β transformation point at a rate of at least 1000° C. per hour.

After the tubes were subjected to heat treatment under the conditions shown in Table 9, the tubes were heated to 800° C. and subjected to ring rolling in the same manner as in Example 7 to obtain titanium rings with a thickness of 11 mm. The rings were then annealed by holding at 670° C. for 15 minutes. The condition of the titanium rings after surface polishing is shown in Table 9.

As can be seen from Table 9, even though the titanium material does not have a thermal history in which it is cooled past the β transformation point at a rate of at least 1000° C. per hour prior to be formed into a tube, if the tube is given such a thermal history by heat treatment, the formation of polished surface patterns on a resulting titanium ring can be prevented.

It will be apparent to those skilled in the art that various modifications of the above-described examples can be made without departing from the scope of the present invention.

TABLE 1

| Run | Titanium plate | | Difference of Vickers | Visible surface |
|---|---|---|---|---|
| No. | Material | Thickness | hardness[1)] | patterns[2)] |
| This invention | | | | |
| 1 | Pure Ti | 15 mm | 9 | ○ |
| 2 | (JIS | 4.5 mm | 4 | ○ |
| 3 | H4600 | 18 mm | 7 | ○ |
| 4 | Type 1) | 7.5 mm | 5 | ○ |
| Comparative | | | | |
| 5 | | 9 mm | 11 | x |
| 6 | | 18 mm | 33 | x |
| 7 | | 13 mm | 26 | x |
| 8 | | 6.5 mm | 17 | x |

[1)]Difference between the minimum and maximum hardness values;
[2)]○ : Not observed, x: Observed.

TABLE 2

| Run | Titanium plate | | Difference of Vickers | Visible surface |
|---|---|---|---|---|
| No. | Material | Thickness | hardness[1)] | patterns[2)] |
| This invention | | | | |
| 1 | Ti alloy | 8 mm | 7 | ○ |
| 2 | (JIS H4605 | 16 mm | 10 | ○ |
| | Type 11) | | | |
| 3 | Ti alloy | 16 mm | 9 | ○ |
| 4 | (ASTM | 7.5 mm | 6 | ○ |
| | Grade 12) | | | |
| Comparative | | | | |
| 5 | Ti alloy | 14 mm | 25 | x |
| 6 | (JIS H4605 | 9.5 mm | 12 | x |

TABLE 2-continued

| Run No. | Titanium plate Material | Thickness | Difference of Vickers hardness[1)] | Visible surface patterns[2)] |
|---|---|---|---|---|
| | Type 11) | | | |
| 7 | Ti alloy | 5 mm | 14 | x |
| 8 | (ASTM Grade 12) | 5 mm | 14 | x |

[1)]Difference between the minimum and maximum hardness values;
[2)]○ Not observed, x: Observed

TABLE 3

| Run No. | Titanium plate Material | Wall Thickness | Difference of Vickers hardness[1)] | Visible surface patterns[2)] |
|---|---|---|---|---|
| This invention | | | | |
| 1 | Pure Ti | 28 mm | 8 | ○ |
| 2 | (JIS | 15 mm | 6 | ○ |
| 3 | H4600 | 11 mm | 9 | ○ |
| 4 | Type 1) | 7.5 mm | 4 | ○ |
| Comparative | | | | |
| 5 | | 25 mm | 15 | x |
| 6 | | 18 mm | 23 | x |
| 7 | | 9.5 mm | 36 | x |
| 8 | | 8 mm | 11 | x |

[1)]Difference between the minimum and maximum hardness values;
[2)]○ Not observed, x: Observed

TABLE 4

| | Test material: Titanium ring of Pure Ti (JIS H4600 Type 1) processed by seam welding | | | | | | | |
|---|---|---|---|---|---|---|---|---|
| | | Heat treatment of ingot | | Rough forging | | Cooling rate in rough forging (°C./hr) | | |
| Run No.[1)] | | Heating temp. (°C.) | Cooling rate (°C./h) | Heating temp. (°C.) | Finish temp. (°C.) | During forging | After forging | Visible surface patterns[2)] |
| CO | 1 | 1100 | 800 | 800 | 600 | 200 | 800 | x |
| TI | 2 | | 1800 | | | | | ○ |
| CO | 3 | 1000 | 800 | | | | | x |
| | 4 | | 800 | 950 | 700 | | | x |
| TI | 5 | | 1800 | 800 | 600 | | | ○ |
| CO | 6 | | 1800 | 950 | 700 | | | x |
| | 7 | | 200 | 800 | 600 | | | x |
| | 8 | | 800 | | | | | x |
| TI | 9 | | 1500 | | | | | ○ |
| | 10 | | 3000 | | | | | ○ |
| | 11 | | 10000 | | | | | ○ |
| CO | 12 | 850 | 800 | | | | | x |
| | 13 | | 1800 | | | | | x |
| | 14 | | 200 | | | | | x |
| | 15 | 750 | 1500 | | | | | x |
| | 16 | | 3000 | | | | | x |
| | 17 | | 10000 | | | | | x |

[1)]TI = This Invention, CO = Comparative
[2)]○ : Not observed, x: Observed.

TABLE 5

Test material: Titanium ring of Pure Ti (JIS H4600 Type 1) processed by seam welding

| Run No.[1] | | Heat treatment of ingot: Heating temp. (°C.) | Heat treatment of ingot: Cooling rate (°C./h) | Rough forging: Heating temp. (°C.) | Rough forging: Finish temp. (°C.) | Cooling rate in rough forging (°C./hr): During forging | Cooling rate in rough forging (°C./hr): After forging | Visible surface patterns[2] |
|---|---|---|---|---|---|---|---|---|
| CO | 1 | 1000 | 800 | 1000 | 900 | 1200 | 200 | x |
| | 2 | | | | | | 800 | x |
| TI | 3 | | | | | | 1600 | ○ |
| | 4 | | | | | | 3000 | ○ |
| CO | 5 | | | | 800 | 200 | 800 | x |
| | 6 | | | | | 500 | | x |
| TI | 7 | | | | | 1600 | | ○ |
| | 8 | | | | | 3000 | 200 | ○ |
| | 9 | | | | | | 1000 | ○ |
| | 10 | | | | | 10000 | 800 | ○ |
| CO | 11 | | | 800 | 600 | 200 | | x |
| | 12 | | | | | 1600 | | x |
| | 13 | | | | | 3000 | | x |
| | 14 | | | | | 10000 | | x |
| TI | 15 | 950 | 3000 | | | 1600 | | ○ |
| | 16 | | | | | 3000 | | ○ |

[1]TI = This invention, CO = Comparative
[2]○ : Not observed, x: Observed.

TABLE 6

Titanium ring produced by seam welding method

| Run No.[1] | | Test material in slabs | Heat treatment of slab: Heating temp. (°C.) | Heat treatment of slab: Cooling rate (°C./hr) | Visible surface[2] |
|---|---|---|---|---|---|
| TI | 1 | Pure Ti | 1100 | 1500 | ○ |
| | 2 | (JIS H4600 | 950 | to 850° C.: 1500 | ○ |
| | 3 | Type 1) | | from 850° C.: 200 | |
| | | | | to 850° C.: 3000 | ○ |
| | | | | from 85° C.: 200 | |
| CO | 4 | | | 800 | x |
| | 5 | | 850 | 3000 | x |
| | 6 | | | 200 | x |
| TI | 7 | Ti alloy | 950 | 1500 | ○ |

TABLE 6-continued

Titanium ring produced by seam welding method

| Run No.[1] | | Test material in slabs | Heat treatment of slab: Heating temp. (°C.) | Heat treatment of slab: Cooling rate (°C./hr) | Visible surface[2] |
|---|---|---|---|---|---|
| CO | 8 | (ASTM | | 200 | x |
| | 9 | Grade 11) | 800 | 1500 | x |
| TI | 10 | Ti alloy | 950 | | ○ |
| CO | 11 | (ASTM | | 200 | x |
| | 12 | Grade 12) | 800 | 1500 | x |

[1]TI = This Invention, CO = Comparative
[2]○ : Not observed, x: Observed.

TABLE 7

Test material: Seamless titanium ring of Pure Ti (JIS H4600 Type 1) processed by ring rolling method

| Run No.[1] | | Heat treatment of ingot: Heating temp. (°C.) | Heat treatment of ingot: Cooling rate (°C./h) | Rough forging: Heating temp. (°C.) | Rough forging: Finish temp. (°C.) | Cooling rate in rough forging (°C./hr): During forging | Cooling rate in rough forging (°C./hr): After forging | Visible surface patterns[2] |
|---|---|---|---|---|---|---|---|---|
| CO | 1 | 1100 | 800 | 800 | 600 | 200 | 800 | x |
| TI | 2 | | 1800 | | | | | ○ |
| CO | 3 | 1000 | 800 | | | | | x |
| | 4 | | 800 | 950 | 700 | | | x |
| TI | 5 | | 1800 | 800 | 600 | | | ○ |
| CO | 6 | | 1800 | 950 | 700 | | | x |
| | 7 | 950 | 200 | 800 | 600 | | | x |
| | 8 | | 800 | | | | | x |
| TI | 9 | | 1500 | | | | | ○ |

TABLE 7-continued

| | | Test material: Seamless titanium ring of Pure Ti (JIS H4600 Type 1) processed by ring rolling method | | | | | | |
|---|---|---|---|---|---|---|---|---|
| | | Heat treatment of ingot | | Rough forging | | Cooling rate in rough forging (°C./hr) | | |
| Run No.[1)] | | Heating temp. (°C.) | Cooling rate (°C./h) | Heating temp. (°C.) | Finish temp. (°C.) | During forging | After forging | Visible surface patterns[2)] |
| | 10 | | 3000 | | | | | ○ |
| | 11 | | 10000 | | | | | ○ |
| CO | 12 | 850 | 800 | | | | | x |
| | 13 | | 1800 | | | | | x |
| | 14 | 750 | 200 | | | | | x |
| | 15 | | 1500 | | | | | x |
| | 16 | | 3000 | | | | | x |
| | 17 | | 10000 | | | | | x |

[1)]TI = This invention, CO = Comparative
[2)]○ : Not observed, x: Observed.

TABLE 8

| | | Test material: Seamless titanium ring of Pure Ti (JIS H4600 Type 1) processed by ring rolling method | | | | | | |
|---|---|---|---|---|---|---|---|---|
| | | Heat treatment of ingot | | Rough forging | | Cooling rate in rough forging (°C./hr) | | |
| Run No.[1)] | | Heating temp. (°C.) | Cooling rate (°C./h) | Heating temp. (°C.) | Finish temp. (°C.) | During forging | After forging | Visible surface patterns[2)] |
| CO | 1 | 1000 | 800 | 1000 | 900 | 1200 | 200 | x |
| | 2 | | | | | | 800 | x |
| TI | 3 | | | | | | 1600 | ○ |
| | 4 | | | | | | 3000 | ○ |
| CO | 5 | | | | 800 | 200 | 800 | x |
| | 6 | | | | | 500 | | x |
| TI | 7 | | | | | 1600 | | ○ |
| | 8 | | | | | 3000 | 200 | ○ |
| | 9 | | | | | | 1000 | ○ |
| | 10 | | | | | 10000 | 800 | ○ |
| CO | 11 | | | 800 | 600 | 200 | | x |
| | 12 | | | | | 1600 | | x |
| | 13 | | | | | 3000 | | x |
| | 14 | | | | | 10000 | | x |
| TI | 15 | 950 | 3000 | | | 1600 | | ○ |
| | 16 | | | | | 3000 | | ○ |

[1)]TI = This invention, CO = Comparative
[2)]○ : Not observed, x: Observed.

TABLE 9

| | | Titanium ring produced by ring rolling method | | | |
|---|---|---|---|---|---|
| | | | Heat treatment of slab | | |
| Run No.[1)] | | Test material in slabs | Heating temp. (°C.) | Cooling rate (°C./hr) | Visible surface[2)] |
| TI | 1 | Pure Ti | 1100 | 1500 | ○ |
| | 2 | (JIS H4600 | 950 | to 850° C.: 1500 | ○ |
| | 3 | Type 1) | | from 850° C.: 200 | |
| | | | | to 850° C.: 3000 | ○ |
| | | | | from 85° C.: 200 | |
| CO | 4 | | | 800 | x |

TABLE 9-continued

| | | Titanium ring produced by ring rolling method | | | |
|---|---|---|---|---|---|
| | | | Heat treatment of slab | | |
| Run No.[1)] | | Test material in slabs | Heating temp. (°C.) | Cooling rate (°C./hr) | Visible surface[2)] |
| | 5 | | 850 | 3000 | x |
| | 6 | | | 200 | x |
| TI | 7 | Ti allaoy | 950 | 1500 | ○ |
| CO | 8 | (ASTM | | 200 | x |
| | 9 | Grade 11) | 800 | 1500 | x |
| TI | 10 | Ti alloy | 950 | | ○ |

TABLE 9-continued

| Titanium ring produced by ring rolling method | | | | |
|---|---|---|---|---|
| | | Heat treatment of slab | | |
| Run No.[1)] | Test material in slabs | Heating temp. (°C.) | Cooling rate (°C./hr) | Visible surface[2)] |
| CO 11 | (ASTM | | 200 | x |
| 12 | Grade 12) | 800 | 1500 | x |

[1)]TI = This Invention, CO = Comparative
[2)]○ : Not observed, x: Observed.

What is claimed is:

1. A titanium ring for use in forming an outer surface of an electrodeposition drum for electrodeposition of metal foil, the ring having a thickness of 4–30 mm and a surface hardness after being polished to an average surface roughness Ra of at most 0.3 μm such that the difference between the maximum and minimum Vickers hardness measured with a load of at most 1 kg at 10 or more points disposed at a pitch of 0.3–1 mm along a line in an arbitrary direction along the surface is at most 10, the surface of the ring being without polished surface patterns.

2. A titanium ring as set forth in claim 1 wherein the ring is made of pure industrial titanium.

3. A titanium ring as set forth in claim 1 wherein the ring is made of a titanium alloy.

4. A titanium ring as set forth in claim 3 wherein the titanium alloy is an α-type titanium alloy.

5. A titanium ring as set forth in claim 1 wherein the thickness of the ring is 6–20 mm.

6. A titanium ring as set forth in claim 1 wherein the ring has been subjected to cooling at a rate of at least 1000° C. per hour past a β transformation point of the titanium.

7. An electrodeposition drum in which a titanium ring as defined in claim 1 is fitted on an inner drum.

* * * * *